US005445283A

United States Patent [19]

Krautkrämer

[11] Patent Number: 5,445,283

[45] Date of Patent: Aug. 29, 1995

[54] CHILD-PROOF SCREW CAP

[75] Inventor: Günter J. Krautkrämer, Budenheim, Germany

[73] Assignee: Jacob Berg GmbH & Co. KG, Budenheim, Germany

[21] Appl. No.: 340,813

[22] Filed: Nov. 17, 1994

Related U.S. Application Data

[63] Continuation of Ser. No. 238,633, May 5, 1994, abandoned.

[30] Foreign Application Priority Data

May 5, 1993 [DE] Germany ..... 43 14 754.2

[51] Int. Cl.[6] ..... B65D 55/02

[52] U.S. Cl. ..... 215/218; 215/219; 215/221; 215/230; 215/250

[58] Field of Search ..... 215/208, 211, 213, 217, 215/218, 219, 220, 221, 226, 206, 230, 250

[56] References Cited

U.S. PATENT DOCUMENTS

| | | | |
|---|---|---|---|
| 3,313,441 | 4/1967 | Fadden | 215/206 |
| 3,615,036 | 10/1971 | Mross | 215/218 |
| 3,869,058 | 3/1975 | Boggrt | 215/219 |
| 3,946,889 | 3/1976 | Gach | 215/219 |
| 4,353,474 | 10/1982 | Luker . | |
| 5,115,928 | 5/1992 | Drummond, Jr. | 215/218 |
| 5,170,900 | 12/1992 | Mangra | 215/218 |
| 5,246,123 | 9/1993 | Kramer et al. . | |

FOREIGN PATENT DOCUMENTS

| | | |
|---|---|---|
| 0393340 | 10/1990 | European Pat. Off. . |
| 2677614 | 12/1992 | France . |
| 2724337 | 12/1978 | Germany . |

*Primary Examiner*—Joseph Man-Fu Moy
*Attorney, Agent, or Firm*—Biebel & French

[57] ABSTRACT

The present invention relates to a plastics screw cap for container closures which is child-proof, with an inner cap (1) with an internal thread (13) which can be screwed onto a neck or a connecting piece of a container for receiving a closure, and an outer cap (2) which is freely rotatable with respect to the inner cap (1) at least in the direction of opening, wherein between the inner and outer caps (1, 2) engaging elements (7, 8, 9, 10) are provided which can only be engaged in an interference fit when a not exclusively tangential force is applied in the direction of opening, in addition to the tangential force effecting the opening moment. In order to provide a closure, that is, a plastics screw cap with the features described in the introduction, which, regardless of the container contents used has a high degree of reliability of function and is easy to operate, it is proposed, according to the invention, that the bases (3, 4) of the inner cap (1) and outer cap (2) fit into one other by means of a cylindrical projection (5) which is arranged concentrically with respect to the axis of the top on one of the bases (3, 4) and a cylindrical recess (6) which is also arranged concentrically to the axis of the top on the other base (4, 3), wherein the recess (6) has a slightly larger diameter than the projection (5).

12 Claims, 1 Drawing Sheet

CHILD-PROOF SCREW CAP

Figure 1:
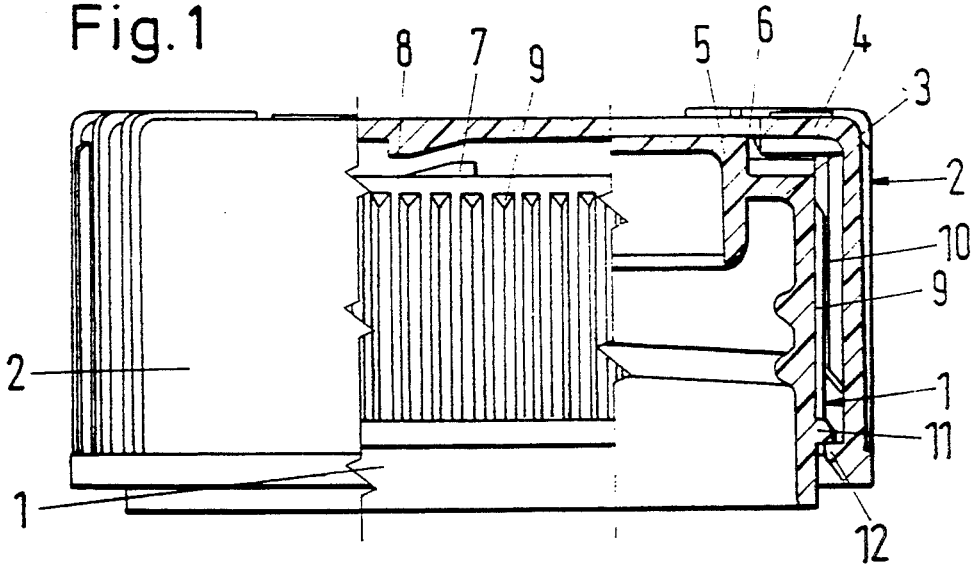

This is a continuation of Ser. No. 08/238,633 filed May 5, 1994 now abandoned.

The present invention relates to a plastics screw cap for child-proof container closures, with an inner cap, the internal thread of which can be screwed onto the neck or connecting piece of a container for receiving a closure, and with an outer cap which can be freely rotated with respect to the inner cap, in the direction of opening, wherein between the inner and outer cap engaging elements are provided, which, when the closure is screwed on, engage with one another by interference fitting and preferably also by keyed fitting, whereas when it is unscrewed the engaging elements can only be engaged by interference fitting, so that the inner cap is rotated with the outer cap, by exertion of a non or not exclusively tangential force in addition to the tangential unscrewing force acting on the outer cap. The connecting piece can, if required, be a separate part to be fitted onto the container.

Such closures, or screw caps, generally described as "child-proof closures" are known in the state of the art in various forms. However, the inner cap itself is generally not accessible and is enclosed in the outer cap, wherein moreover, safety elements ensure that the outer cap cannot simply be pulled off the inner cap. In a variation of the known child-proof closures, to open the closure an axial pressure must be exerted on the outer cap in addition to rotating the outer cap in the direction of opening, so that the outer cap and inner cap fit together by interference fitting, and when the outer cap is rotated, the inner cap, which forms the actual closure provided with a thread, is taken along in the direction of opening. For this purpose, for example, an asymmetrical tooth system is provided on the inside of the base of the outer cap and the outside of the base of the inner cap, wherein when the outer closure cap is rotated in the direction of closure, coarse flanks of the two tooth systems always come to lie on each other so that a keyed fit occurs and the inner cap is simply taken along when the outer cap is rotated in the closing direction, whereas conversely, when the outer cap is rotated in the direction of opening, relatively flat tooth flanks lie on each other or at least one of the tooth systems is provided with a flat flank in this direction which is easily conducted over the opposite tooth flank or the projection on the other part, when the outer cap is simply rotated in the direction of opening. Slipping of these tooth flanks can only be prevented by sufficient axial force, which thereby produces an interference fit engagement between the outer and inner cap.

In another variation, during unscrewing, the more or less pliable, cylindrical cover of the outer cap is pressed in radially, preferably from opposite sides, wherein a groove on the inside of the outer cap cover and a corresponding groove on the outside of the cover of the inner cap engage with each other in the radially pressed in areas, so that by means of this so-called "ovalising" of the outer cap in the direction of opening as well as of closing, a connection between the outer cap and inner cap is produced. By means of such closures, small children should be prevented from coming into contact with substances in the container which are dangerous for them, such as for example, medicines, cleaning products, alcohol and so on, wherein it is assumed that although children of a certain age are able to open simple screw closures by rotation, at the same time however have no experience and also insufficient strength and dexterity to exert an additional non-tangentially directed force besides just the unscrewing motion to the (outer) closure cap, in particular however, they neither recognise nor know that an additional force in a certain direction has to be exerted in order to able to open the closure.

Of course, with this the outer cap and inner cap have to be provided with a certain guidance relative to one another so that, for example, opening of the closure is not possible simply because of more or less accidental tipping of the outer cap with respect to the outer cap, so that the engaging elements fit together even without exertion of an additional force in such a way that unscrewing of the closure is possible. With insufficient guidance, it could happen that the engaging elements also do not fit correctly together during screwing on, so that screwing on of such closures also becomes difficult. The guidance of the outer cap on the inner cap is therefore generally done by means of the cylindrical outside wall of the inner cap and the cylindrical inside wall of the outer cap.

Such closures are however not equally well suited to all types container contents. There are for example contents which swell or produce a more or less strong internal pressure, by which the inner closure cap is expanded or stretches. This can lead to the outer cap no longer being freely rotatable with respect to the inner cap in the direction of opening, so that the closure then loses its child-proof function. A greater clearance between the engaging elements in the closures to be made oval can be provided, and the guidance of the caps on one another can for example be ensured by means of flanges which grip on top of one another, but this does not however rule out on the one hand that when the inner cap swells, the flanges interference fit together, and on the other hand that the operation of the closure is thereby made difficult as the outer cap has to be made more oval, which requires more force or necessitates the use of a relatively soft material which entails the danger of accidental or chance separation of the outer cap from the inner cap.

The object of the present invention, with respect to this state of the art, is to provide a closure, that is, a plastics screw cap with the features described in the introduction, which, regardless of the type of container contents being used, has a high degree of reliability of function and is easy to operate.

This object is solved in that the screw cap mentioned in the introduction is also provided with the features that the bases of the inner cap and outer cap fit into one other by means of a cylindrical projection which is arranged concentrically with respect to the axis of the closure on one of the bases and a cylindrical recess which is also arranged concentrically to the axis of the closure on the other base, wherein the recess has a slightly larger diameter than the projection.

By these means the guidance of the outer cap on the inner cap no longer has to be done by means of the cylindrical walls of the outer cap and inner cap, which additionally also still have other functions to perform, but instead these guidance functions are assigned to separate elements specially conceived therefor, namely the cylindrical projection and the corresponding recess, which fit together with a small amount of clearance. Of course, within the term "cylindrical" a hollow cylinder is also to be understood, if applicable, so that an embodiment in which the recess is for example in the shape of a circular groove, while a circular pin fitting into the groove is provided as the cylindrical projection, which in other words forms a (hollow) cylindrical projection, falls within the presently described wording of claim 1.

In a preferred embodiment of the invention, the recess penetrates the base of the associated cap, and moreover in a particularly preferred embodiment of this type, the recess is formed in the base of the outer cap, and the cylindrical projection as an outer, cylindrical continuation of the base of the inner cap. The recess can however also simply be in the form of an indentation in the respective cap base without completely penetrating it, for example, in the form of a circular hole.

The engaging elements are in this case preferably provided on the faces of the outer and inner cap, that is, on the one hand on the outside of the base of the inner cap and on the other hand on the inner surface of the base of the outer cap, and located opposite each other so that they can engage with each other and moreover are located radially outside the cylindrical projection and the recess.

On the ends of the outer and inner caps adjacent to the respective cap bases retaining elements are conveniently provided, which prevent pulling apart of the outer and inner caps. These retaining elements can, for example, be in the form of projecting shoulders, so that the inside wall of the outer cap projects inwardly in the proximity of the edge of the cap, whereas conversely, a shoulder or projection projects outwardly from the outside wall of the inner cap in the proximity of the edge. For the formation of shoulders or projections of this type, preferably at least partially radial flanges are to be provided, wherein of course in the area of these projections or flanges the internal diameter of the outer cap is smaller than the external diameter of the inner cap in the area of the projections or flanges, and these flanges or projections are provided with ramps or inclined surfaces on their sides, which in their assembled state, are opposite each another, which facilitate the fitting together of the two caps. It can moreover also be convenient if at least the inwardly protruding flange of the outer cap is interrupted by two oppositely located sectors in the region of approximately 10° to 60°, wherein at least in this area grooves are provided on the inner cover surface of the outer cap, which, when the cap is made oval by pressing together of opposite sections of the wall, engage with corresponding grooves in the outer cover surface of the inner cap, and thus produce an interference fit between the outer and inner cap. The omission of the flange in this area to be pressed together facilitates the contact pressing of the grooves of the outer cap onto those of the inner cap, wherein however, this feature is not indispensable.

Furthermore, the flanges or projections are positioned on the outer cap and the inner cap in an axial direction in such a way that the inner cap received by the outer cap has sufficient axial clearance so that the tooth systems fitted onto the faces or bases can slide over each other easily during unscrewing without the exertion of an axial pressure. The axial clearance must thus correspond to at least the height of the engaging elements or teeth on the base of the inner cap or outer cap.

It is moreover advantageous when the outer cap is provided with grooves on its outside exactly in the areas where corresponding grooves are also provided on the inside for engaging with the inner cap. In this way the user can recognise in which areas the outer cap is to be held and to be pressed together in order to make it engage in a fixed manner with the inner cap. The grooves on the outside of the outer cap also facilitate the application of a turning moment necessary for the opening and closing of the closure.

Figure 2:
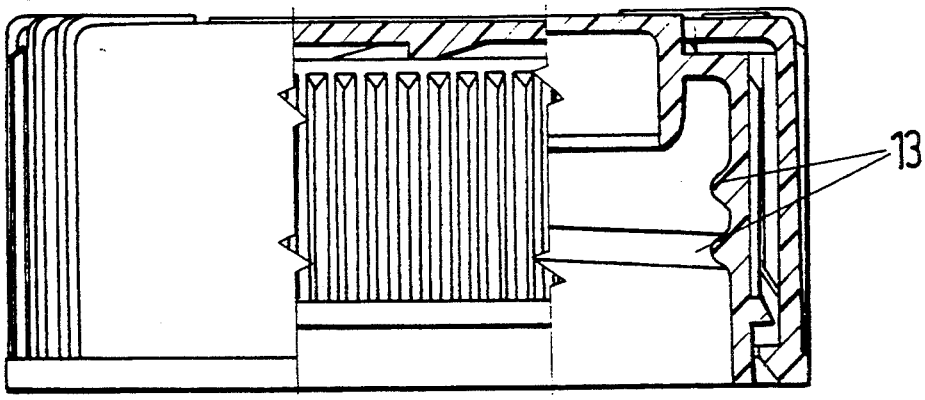
Figure 3:
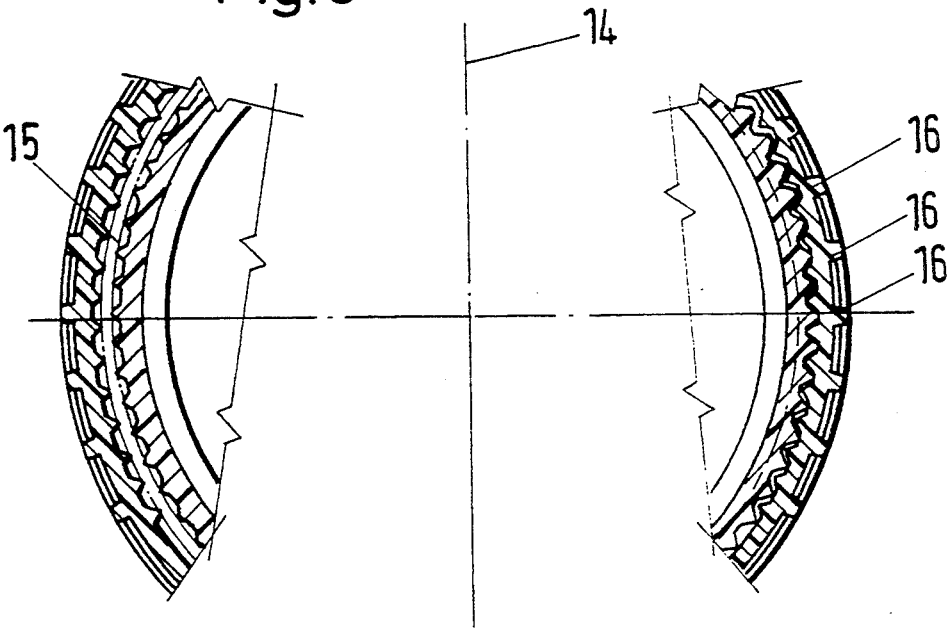

Further advantages, features and possibilities for use of the present invention will be clearly described with the aid of the following description or a preferred embodiment and the associated drawings, wherein:

FIG. 1 shows a double closure cap in a position in which the outer and inner caps are rotatable with respect to one another, FIG. 2 the closure according to FIG. 1 in a position in which the outer and inner caps are engaged in a fixed manner, and FIG. 3 a partial section along a plane vertical to the axis through a closure according to FIGS. 1 and 2.

The right hand third of FIG. 1 shows a section through the inner cap 1 and the outer cap 2 approximately along a plane of the axis 14 of the closure. In the central section of FIG. 1 only the outer cylindrical cover wall 18 of the outer cap 2 is shown, cut away so that the outside wall of the inner cap 2 can be seen. In approximately the left hand third of FIG. 1 and FIG. 2 essentially only the outside wall of the outer cap 2 can be seen.

The basic shape of the inner cap 1 and also the outer cap 2 is that of a cylinder which is closed at one end. Departing from this simple cylindrical basic shape, the base 3 of the inner cap 1 is provided with a cylindrical projection 5, while the base 4 of the outer cap 2 is provided with a circular recess 6 into which the cylindrical projection 5 engages with a small amount of clearance. The inner cap has moreover an internal thread 13 as well as a circular flange 11 on its outside in the proximity of its open end, with a radially extending contact surface which makes contact with a surface of a flange 12 also extending radially, which is provided at least partially radially on the inner open end of the cylindrical cover wall of the outer cap 2.

In the position shown in FIG. 1, in which radially extending surfaces of the flanges 11 and 12 lie on each other and thereby prevent further axial pulling out of the inner cap from the outer cap, engaging elements 7, 8 which are arranged in the base 3 of the inner cap and on the base 4 of the outer cap are not engaged. These engaging elements 7, 8 are composed of a type of asymmetrical teeth each with a coarse flank and a ramp surface, wherein the engaging elements 7, 8 are so arranged and designed that when the outer cap 2 is rotated in the direction of closing, the coarse flanks of the teeth 7, 8 engage with each other, whereas when rotating in the opposite direction, that is in the direction of opening of the closure, the relatively shallowly inclined ramp surfaces of the teeth 7, 8 engage with each other. In this way by engagement of ramp surfaces and with further rotation of the outer cap 2 in the direction of opening, a force is exerted on the outer cap 2 and the inner cap 1 by means of which they are axially forced apart from each other in the direction of the position shown in FIG. 1. In other words, the ramp surfaces of the teeth 7, 8 slide on each other and thereby press the outer cap 2 and the inner cap 1 axially away from each other, until the elements 7, 8 have slid over each other. The position of the flanges 11, 12 is thereby selected so that the teeth 7, 8 can no longer engage with each other in the position of an installation of the flanges 11, 12 shown in FIG. 1.

The sliding over each other of the ramp surfaces of the teeth 7, 8 can only be prevented by simultaneous exertion of an axially (downwards in FIG. 1) directed pressure on the outer cap 2 during unscrewing, which compensates for the axial force which forces them apart, acting by means of the turning moment and inclined position of the ramp surfaces 7, 8. With exertion of sufficient axial pressure on the outer cap 2, the axial forcing apart of the outer cap and the inner cap can be prevented, so that the inner cap 1 is taken along, over the ramp surfaces of the teeth 7, 8 which lie on top of each other and are no longer sliding over each other, when the outer cap 2 is rotated in the direction of opening.

FIG. 2 shows a position of the closure cap, which is normally adopted during screwing on of the closure. When the container is normally closed, a closure neck is generally located upwards, and the closure is in the position shown in FIGS. 1 and 2, or is possibly slightly inclined with respect to the horizontal. The tare mass of the outer cap 2 ensures that in any case it lowers itself onto the inner cap until its teeth 8 lie on the outer surface of the base of the cap 2 of the inner cap 1. This could, for example, be in the position shown in FIG. 2, wherein however the outer cap 2 and inner cap 1 can still adopt different angular positions, so that firstly the coarse flanks of the teeth 7, 8 do not yet engage with each other. In any case with the presently described closure, during screwing on of the closure the position shown in FIG. 2 is obtained, in which the coarse flanks of the teeth 7, 8 engage with each other so that when a turning moment is exerted on the outer cap 2 in the direction of closing, the inner cap 1 is taken along in any case over the teeth 7, 8.

In the state shown in FIG. 1 and in FIG. 2, the cylindrical extension 5 engages in the circular recess 6 of the base 4 of the outer cap 2 and ensures accurate guidance during rotation of the outer cap with respect to the inner cap, particularly when rotating in the direction of opening, when the inclined surfaces of the teeth 7, 8 should slide over each other in the function of childproofing. Tipping is additionally also avoided by the possible engagement of the flanges 11, 12, which allow only a limited axial clearance between the outer cap and the inner cap.

In addition to the teeth 7, 8 already described, the inner cap 1 and outer cap are also provided with further engaging elements in the form of grooves 9 and 10. With this, the inner cap 1, with its groove 9 on its outer cover surface and the outer cap 2 with its groove 10 on its inner cover surface are dimensioned so that when the outer cap and inner cap have their normal circular shape, the smallest internal diameter of the outer cap is still larger than the largest external diameter of the inner cap in the area of the respective grooves 9, 10. The grooves 9, 10 do not engage with each other in the direction of opening as well as closing and the outer cap 2 would be freely rotatable with respect to the inner cap 1 in both directions as long as the further engaging elements 7, 8 were not acting. In the normal state between the grooves 9, 10 there is the free space 15 or an amount of clearance 15 shown in the left hand part of FIG. 3. This clearance 15 can however be dispensed with by, for example, pressing in the cover surface of the outer cap 2 in an axial direction, advantageously by engaging the cover surface of the cap 2 from two opposite sides, so that the cap, for example, is pressed together between the thumb and forefinger. With this, the position shown in the right hand part of FIG. 3 is adopted, in which the grooves 9, 10 of the outer cap 2 and inner cap 1 are engaged in a toothed manner.

Preferably, the outer cap 2 is also provided in the pressed-together areas with more external teeth or grooves 16, which facilitate the engagement and application of a turning moment and at the same time are a marker of the areas which are to be pressed together, as preferably the inner groove 10 of the outer cap extends only over two oppositely located angular sectors of a size of about 30° to 80°, so that pressing together of the outer cap 2 outside these sectors does not produce engagement between the grooves 9, 10.

It can be convenient in this case, even when not shown in the drawings, that the flange 12 and possibly also the flange 11 is interrupted in a sector corresponding to the grooved sector or are shortened radially, which facilitates the pressing together of the outer cap 2 and the engagement of the grooves 9,10.

Also in connection with the grooves 9, 10 on the cover surfaces, the concentric guidance of the outer cap with respect to the inner cap with the aid of the extension 5, which engages in the recess 6, is of substantial importance, as namely only by accurate concentric guiding can the free space or clearance shown in the left part of FIG. 3, between the teeth 9, 10 over the whole circumference of the inner cap or in the sector areas where both teeth 9, 10 are available, be ensured. The closure according to the invention thereby guarantees a high degree of reliability of function, wherein the preferred embodiment is preferably with a combination of the engaging elements 7, 8 and 9, 10.

As, in the embodiment shown, the recess 6 completely penetrates the base 4 of the outer cap 2, a curvature of the base 3 of the cap in the central area, that is, in the area of the cylindrical extension 5, would no longer get in the way as the base 4 of the cap is recessed in this area. A radial expansion of the cover of the cap 1 because of swelling contents of a container or because of the build up of an internal pressure also does not interfere with the functional capability of the closure as the free pay or the free space 15 can be selected in any case to be large enough that there is no engagement of the grooves 9, 10 without firm pressing together of the walls of the outer cap 2.

Moreover, in the preferred embodiment of the invention, on the inner closure cap on the lower edge a so-called guarantee band is arranged, which is not shown as such in the drawings. A guarantee band of this type is typically normally connected by means of a row of tear-off tabs to the lower edge of a screw cap, in this case the inner cap, and is usually formed so that it hooks onto the neck or the connecting piece of the container by means of a projection, so that when the cap is screwed undone, the guarantee band is held tight on the neck of the container, wherein the connecting tabs tear and thereby tear or separate the whole guarantee band from the closure cap. A disconnected guarantee band is then an indication that the closure has already been opened once before. The hooking of the guarantee band to the neck of the container can be achieved in principle in the same way as the hooking or mutual securing of the outer closure cap to the inner closure cap already described, by means of the projections or flanges 11, 12 wherein with guarantee bands it is usual—but not obligatory—for these to be composed of individual segments connected together and each of the segments has its own small projection which hooks onto a corresponding flange on the neck or connecting piece of a container after the unscrewing of the closure cap concerned.

It is particularly advantageous, according to the present invention, that the outer cap and inner cap are two pan which are not joined in a fixed manner and are to be manufactured separately, wherein the tear-off band or guarantee band is affixed to the inner cap. This makes it possible, in particular, to manufacture the outer cap and inner cap in different colours, selectively also from materials with different mechanical properties, so that the guarantee ring or the guarantee band which is produced integrally with the inner cap from the same material and in the same colour clearly shows visibly, in a colour which can be clearly differentiated from that of the outer cap, under the edge of the outer cap, and is visible from the outside, without affecting the free movement of the outer cap with respect to the inner cap.

I claim:

1. Plastics screw cap for child-proof container tops, with an inner cap, with an internal thread which can be screwed onto the neck or connecting piece of a container for receiving a closure, and with an outer cap which can be freely rotated with respect to the inner cap, at least in the direction of opening, wherein on the outer cover surface of the inner cap and the inner cover surface of the outer cap, serrations are provided for opening said screw cap, wherein the smallest internal diameter of the outer cap in the area of the serrations is larger than the largest external diameter of the inner cap including the serrations thereof and wherein said serrations can only be engaged by interference fitting by exertion of a radial force in addition to the tangential force effecting the opening moment, characterised in that the bases of the inner cap and outer cap fit into one another by means of a cylindrical projection which is arranged concentrically with respect to the axis of the closure on one of the bases and a cylindrical recess which is also arranged concentrically to the axis of the closure on the other base, wherein the recess has a slightly larger diameter than the projection.

2. Screw cap according to claim 1, characterised in that the recess penetrates the base of the associated cap.

3. Screw cap according to claim 1, characterised in that the recess is provided on the base of the outer cap and the projection as an outer, cylindrical extension of the base of the inner cap.

4. Screw cap according to claim 1, characterised in that the recess is formed as a circular groove, and the projection as an axially shorter section of wall of a hollow cylinder.

5. Screw cap according to claim 1, characterised in that engaging elements are provided radially outside the recess or respectively the projection, on the face of the inside of the base of the outer cap and on the outside of the base of the inner cap for interference fitting only upon a closing rotation of said screw cap.

6. Screw cap according to claim 1, characterised in that in the proximity of the open ends of the inner cap and the outer cap projections or shoulders, preferably in the form of radial flanges are provided.

7. Screw cap according to claim 6, characterised in that the projections or flanges are positioned so that the inner cap held in the outer cap by the projections or flanges has an axial clearance, which corresponds to at least the axial height of one of the engaging elements.

8. Screw cap according to claim 6, characterised in that the surfaces of the flanges which are adjacent when assembled, are inclined surfaces or tapered surfaces inclined towards the axis of the closure.

9. Screw cap according to claim 6, characterised in that at least the projection or flange which is arranged on the inside of the outer cap is provided with a sector-like interruption.

10. Screw cap according to claim 1, characterised in that the outer cap and the inner cap are of different colours.

11. Screw cap according to claim 9, characterised in that the sector-like interruption of the flange is located in the same sector as the groove of the outer cap.

12. Screw cap according to claim 1, characterised in that on the lower edge of the inner cap a guarantee band is affixed by means of a tear-off connection, preferably in the form of tabs, which after unscrewing of the inner cap is secured to the neck or connecting piece of the container so that when the inner cap is screwed undone the connection between the inner cap and the guarantee band tears, so that the latter remains on the neck or connecting piece of the container.

* * * * *